US006622798B1

(12) United States Patent
Rogers et al.

(10) Patent No.: US 6,622,798 B1
(45) Date of Patent: Sep. 23, 2003

(54) METHOD AND APPARATUS FOR MAINTAINING A FLUID COLUMN IN A WELLBORE ANNULUS

(75) Inventors: Henry E. Rogers, Duncan, OK (US); Harold O. Treece, Duncan, OK (US); Grant L. Hartman, Walters, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 10/141,598

(22) Filed: May 8, 2002

(51) Int. Cl.[7] ..... E21B 33/14

(52) U.S. Cl. ..... 166/380; 166/291; 166/154; 166/177.4

(58) Field of Search ..... 166/285, 290, 166/380, 381, 154, 177.4, 291, 387

(56) References Cited

U.S. PATENT DOCUMENTS

| | | | | |
|---|---|---|---|---|
| 3,358,770 A | | 12/1967 | Zandmer | 166/224 |
| 3,526,280 A | | 9/1970 | Aulick | 166/285 |
| 3,572,432 A | | 3/1971 | Aulick | 166/114 |
| 4,384,616 A | | 5/1983 | Dellinger | 166/376 |
| 4,547,298 A | * | 10/1985 | Novak | 507/118 |
| 4,671,358 A | | 6/1987 | Lindsey, Jr. et al. | 166/291 |
| 4,986,361 A | | 1/1991 | Mueller et al. | 166/381 |
| 4,991,668 A | * | 2/1991 | Rehm et al. | 175/61 |
| 5,086,843 A | | 2/1992 | Mims et al. | 166/380 |
| 5,086,844 A | | 2/1992 | Mims et al. | 166/383 |
| 5,117,915 A | | 6/1992 | Mueller et al. | 166/381 |
| 5,150,756 A | | 9/1992 | Hassanzadeh | 166/318 |
| 5,170,847 A | | 12/1992 | Mims et al. | 166/383 |
| 5,174,375 A | | 12/1992 | Mims et al. | 166/117 |
| 5,181,571 A | | 1/1993 | Mueller et al. | 166/381 |
| 5,456,317 A | | 10/1995 | Hood, III et al. | 166/296 |
| 5,829,526 A | | 11/1998 | Rogers et al. | 166/291 |
| 6,354,378 B1 | * | 3/2002 | Patel | 166/374 |
| 6,505,685 B1 | * | 1/2003 | Sullaway et al. | 166/386 |

FOREIGN PATENT DOCUMENTS

| | | | |
|---|---|---|---|
| EP | 0 306 306 A1 | 3/1989 | E21B/33/05 |
| EP | 0 697 496 A2 | 2/1996 | E21B/33/16 |
| WO | WO 91/03620 | 3/1991 | E21B/33/14 |

* cited by examiner

*Primary Examiner*—Frank S. Tsay
(74) *Attorney, Agent, or Firm*—John W. Wustenberg; Craig W. Roddy; Anthony L. Rahhal

(57) ABSTRACT

A method and apparatus for maintaining the fluid column in an annulus are provided. The fluid column support, or fluid column seal is disposed about a second casing being lowered into a well through a first casing already cemented in the well. The fluid column support includes a seal connected to the second casing that engages the first casing as it is lowered therethrough. The seal will allow flow in an upward direction but prevents downward flow. The seal will support, or maintain a fluid column in the annulus between the first and second casing in the event that the fluid level below the seal drops for any reason, such as lost circulation or the failure of a buoyancy chamber in the second casing. The fluid seal, in conjunction with stage tools, provides hydrostatic pressure in the well to maintain proper fluid placement therein.

21 Claims, 7 Drawing Sheets

METHOD AND APPARATUS FOR MAINTAINING A FLUID COLUMN IN A WELLBORE ANNULUS

BACKGROUND OF THE INVENTION

The present invention relates to a method and apparatus for maintaining a fluid column height in a well. More specifically, the present invention relates to a method and apparatus for maintaining a fluid column height in an annulus between a first casing cemented in the well and a second casing being installed therethrough, thus maintaining hydrostatic pressure in the well.

In recent years, the drilling and completion of highly deviated wells, including horizontal wells, has increased appreciably. A horizontal well is one which includes one or more horizontal wellbore sections (i.e., wellbore sections drilled at an angle from a vertical of about 60° or greater). The horizontal or deviated wellbore section or sections usually extend from a vertical or inclined wellbore section. The drilling of a horizontal well or section in a hydrocarbon producing zone allows more of the zone to be in direct contact with the wellbore which results in a higher displacement efficiency of the zone as a whole. In some "extended reach wells," the horizontal wellbore sections frequently approach 90° from vertical, and the horizontal wellbore sections are longer than the vertical sections. To complete horizontal wells, a casing string usually must be run into the horizontal wellbore section by sliding it through the wellbore. The drag forces exerted on the casing string can damage the joints at their threaded connections. As a result, expensive heavy casing joints with premium thread connections and torque shoulders have been utilized. The casing string can also become stuck as a result of differential pressures, which require the application of additional forces on the casing string. If sufficient additional forces cannot be applied, the stuck pipe may result in the loss of the well.

A number of techniques have been developed and used for decreasing the forces required to run casing strings in horizontal wells. For example, the wellbore drilling fluid has been replaced with a high-density fluid prior to running a casing string in a horizontal wellbore section to provide buoyant forces on the casing. In addition, a retrievable packer has been included in the casing string for the purpose of trapping a fluid lighter than the wellbore fluids between the packer and the end of the casing string. U.S. Pat. No. 4,986,361 dated Jan. 22, 1991, U.S. Pat. No. 5,117,915 dated Jun. 2, 1992, and U.S. Pat. No. 5,181,571 dated Jan. 26, 1993, all issued to Mueller et al., disclose apparatus for trapping air in the leading portion of a casing string to increase the buoyancy of the casing string in the drilling fluid contained in the wellbore. U.S. Pat. No. 5,829,526 (the '526 patent) discloses an apparatus for trapping air in a first portion of the casing string causing the casing string to be buoyed up during placement by drilling fluid in the wellbore. The '526 patent further discloses a selectively openable and releasable closed baffle assembly connected in the casing string for trapping a low density fluid, preferably air, in a second portion of the casing string, thereby causing it also to be buoyed up during placement of the casing string in the well by the drilling fluid in the wellbore.

The methods and apparatus described above have been successfully utilized for reducing casing string drag and eliminating the need for expensive heavy casing joints when placing a casing string in a horizontal wellbore. There are, however, potential risks associated with placement in the well of casing strings having buoyancy chambers therein. If the buoyancy chamber develops a leak or catastrophically fails and thus collapses, the fluid column in the wellbore will drop dramatically, as fluid in the wellbore moves to occupy the space originally filled by the buoyancy chamber. A loss of hydrostatic head will accompany the drop in fluid level. Such a loss in hydrostatic head can result in a severe well control situation and can cause loss of the control of the well, which is both dangerous and costly. Thus, there is a need for a method and apparatus for maintaining a fluid column in an annulus between a first casing string installed in a well and a second casing string being placed therethrough, when a potential for a drop in fluid level in the well exists.

SUMMARY OF THE INVENTION

The present invention provides an improved method and apparatus for maintaining a fluid column in an annulus between a first casing cemented in a well and a second casing being lowered therethrough. The apparatus of the present invention comprises a fluid column support, or fluid column seal disposed about and movable with the second casing. The fluid column support will engage the first casing cemented in the well. The fluid column support will allow flow upwardly in the annulus between the second casing and the first casing cemented in the well, but will prevent downward flow so that a column of fluid is supported in the annulus by the fluid column support. Because a fluid column is supported in the annulus, hydrostatic pressure can be maintained in the well in situations where a fluid level below the fluid column support drops in the well.

For example, the second casing may comprise a second casing being placed in a deviated well. The second casing may therefore include a float shoe at a lower end thereof and a float collar connected in the second casing above the float shoe. Connected casing joints between the float shoe and float collar may be filled with air or other compressible fluid to define a buoyancy chamber in the second casing.

The fluid column support is disposed about and movable with the second casing and will engage the first casing so that if the fluid level in the well below the fluid column support drops for any reason, such as for example a failure of the buoyancy chamber such that drilling fluid or other fluid in the well moves to occupy the space previously occupied by the buoyancy chamber, a column of fluid will be maintained in the annulus. There are preferably a plurality of fluid column supports spaced at intervals along the second casing. Because at least one of the plurality of seals disposed about the second casing will always be in engagement with the first casing as the second casing is being lowered therethrough to a desired location in the well, a column of fluid will always be supported in the annulus if the fluid level in the well below the engaged fluid column support drops for any reason, such as a failure of the buoyancy chamber.

The present invention thus provides a method and apparatus for maintaining a column of fluid in an annulus between a casing cemented in a wellbore and a second casing being lowered therethrough, and for retaining hydrostatic pressure in the well if the fluid level in the well below the supported column of fluid drops for any reason.

BRIEF DESCRIPTION OF THE DRAWINGS

FIG. 6 is a cross-sectional view of the embodiment of FIG. 5 showing a displacement plug passing therethrough.

DESCRIPTION OF A PREFERRED EMBODIMENT

There are a number of wellbore applications in which it is desirable to maintain a fluid column in an annulus between a casing installed in the well and a second casing or other pipe being lowered therethrough. Once such application is where a string of casing is being placed in a wellbore that includes a horizontal wellbore section. As is well understood, horizontal wells generally include a first vertical or inclined wellbore section which is connected to one or more horizontal wellbore sections. The horizontal wellbore section or sections can deviate from vertical at least about 60° and can often deviate as much as 90° or greater. U.S. Pat. No. 5,829,526, the details of which are incorporated herein by reference, discloses a string of casing being lowered into a horizontal well, wherein the string of casing has a buoyancy chamber which is typically filled with air at the lower end thereof. The buoyancy chamber reduces the forces required to be exerted on the casing string during placement in the horizontal well. There is, however, a potential risk of failure of the buoyancy chamber. If the buoyancy chamber fails, the level of fluid in the well will drop as fluid in the well fills the area originally occupied by the buoyancy chamber. Thus, the present invention provides an apparatus and method for maintaining a fluid column in an annulus between a casing installed in a wellbore and a second casing or other pipe being lowered therethrough. The term "casing" is used herein to mean a casing, liner or other pipe, which is to be cemented in a wellbore.

Figure 1A:
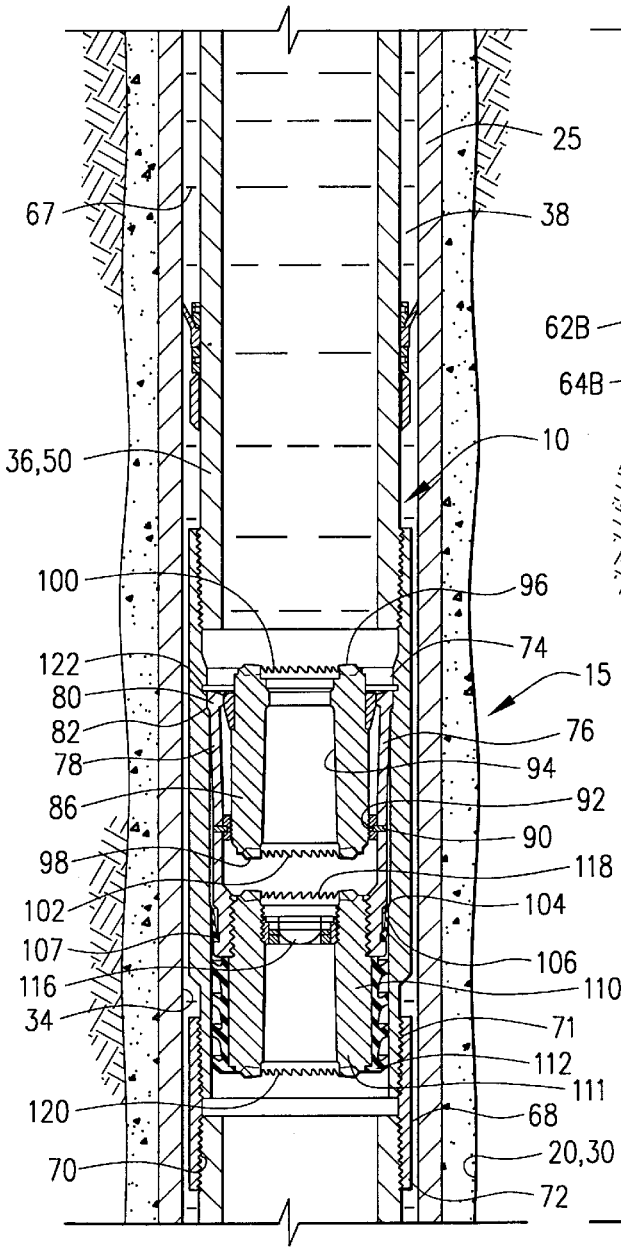
FIGS. 1A & 1B show a cross-sectional view of the apparatus of the present invention being lowered into a wellbore.
Figure 1B:
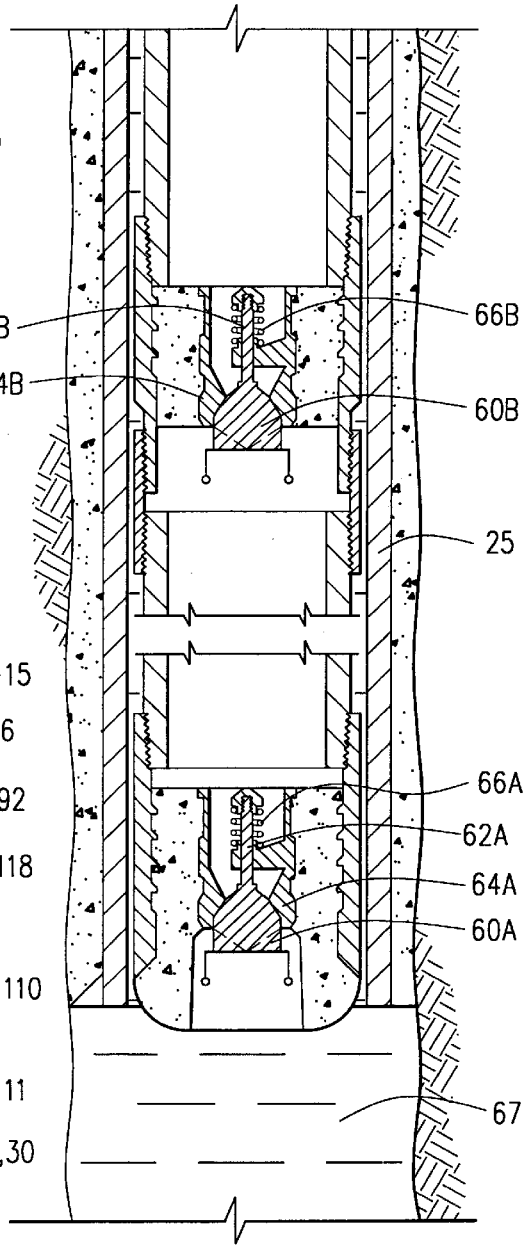
Figure 2:
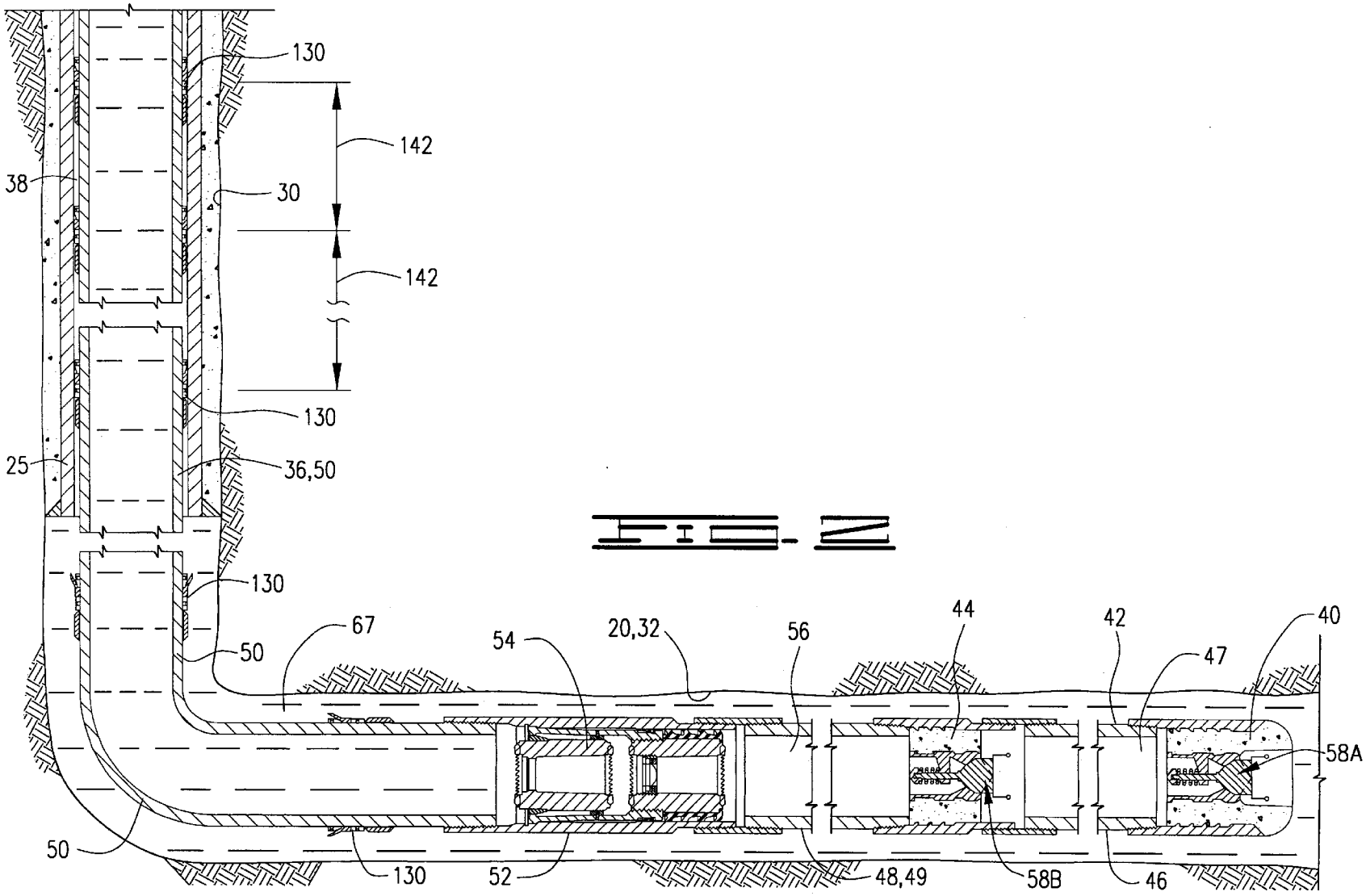
FIG. 2 shows the apparatus of the present invention in a horizontal wellbore.

Referring now to FIG. 1, an apparatus 10 for maintaining a fluid column between a first pipe cemented in a wellbore, and a second pipe being lowered therethrough, and more particularly an apparatus for maintaining a fluid column in an annulus between the first casing cemented in a wellbore and a second casing being lowered therethrough is shown and described. The apparatus may also be referred to as an apparatus for maintaining hydrostatic pressure in a well. FIGS. 1 and 2 show a well 15 comprising a wellbore 20 having a casing 25 cemented therein. As shown in FIG. 2, well 15 is preferably a horizontal well comprising vertical or inclined wellbore section 30 and horizontal or deviated wellbore section 32.

Casing 25 may be referred to as a first casing 25. First casing 25 has an inner surface 34. Apparatus 10 comprises a casing string 36 which may be referred to as a second casing 36. FIG. 1 shows second casing 36 being lowered through first casing 25, and FIG. 2 shows the apparatus after a lower portion of second casing 36 has been placed in horizontal portion 32 of well 15, with a portion of second casing 36 still positioned in casing 25. An annulus 38 is defined between second casing 36 and first casing 25. Second casing 36 comprises a conventional float shoe 40 connected to a plurality of connected casing joints 42. The opposite, or upper end of the connected casing joints 42 is connected to a conventional float collar 44. The float shoe 40, connected casing joints 42 and float collar 44 make up a first portion 46 of second casing 36 which is filled with air, designated by the numeral 47. First portion 46 may also be referred to as a buoyancy chamber 46. Connected to the opposite end of float collar 44 from connected casing joints 42 is another plurality of connected casing joints 48. Connected casing joints 48 are connected at the upper end thereof to a plurality of connected casing joints 50 by a threaded casing sub 52. Threaded casing sub 52 is part of a baffle assembly 54 which is like that shown in FIG. 9 of U.S. Pat. No. 5,829,526 and which is described in more detail herein.

Casing joints 50 extend to the surface and are made up on the surface as second casing 36 is being inserted into the well. Thus float shoe 40 is connected to the end of the first of casing joints 42 and float shoe 40 and the first of casing joints 42 are run into the well. Additional casing joints 42 are connected to the first casing joint 42 and the first of additional casing joints 42 are run into the well without filling them with drilling or other fluid, thereby forming buoyancy chamber 46 containing only air. The float collar 44 is next connected to the upper end of first portion or buoyancy chamber 46, which traps the air therein. Additional casing joints 48 are connected to float collar 44 and to each other forming second casing portion 49, which may also be referred to as a second buoyancy chamber 49. The baffle assembly 54 is connected to the uppermost of casing joints 48. Second buoyancy chamber 49 is filled with air or other low-density fluid 56.

The structure and operation of the float shoe 40 and float collar 44 are conventional and well understood. As illustrated in the drawings, both the float shoe 40 and float collar 44 include spring-biased check valves 58*a* and 58*b*, respectively, comprised of valves 60*a* and 60*b* connected to valve stems 62*a* and 62*b*. Valves 60*a* and 60*b* seat on valve seats 64*a* and 64*b* respectively and are urged to the closed position by springs 66*a* and 66*b*. The float shoe 40 and the float collar 44 allow pressurized fluid outflow in the direction toward and through the leading end of second casing 36, but prevent inflow. Thus, air trapped within first buoyancy chamber 46 is prevented from entering second buoyancy chamber 49 by check valve 58*b*. Air is initially prevented from flowing through check valve 58*a* of float shoe 40 by the bias supplied by spring 66*a*. As the apparatus 10 is lowered into the well, hydrostatic pressure of drilling fluid in the wellbore is greater than the pressure of the air in buoyancy chamber 46, which prevents the check valve from opening.

Well 15 will be filled with a drilling fluid 67, which will also be placed in connected casing joints 50 as the joints are made up on the surface and second casing 36 is lowered into the well. The term "drilling fluid" is used herein to mean any fluid utilized to drill the wellbore 20 or otherwise circulated into the wellbore 20 and/or annulus 38. The drilling fluid is commonly an aqueous fluid containing viscosifying agents such as hydratable clays and polymers, weighting materials and other additives. Regardless of the particular type of drilling fluid used, it should have as high a density as is practical without exceeding the fracture gradients of the subterranean zones penetrated by the wellbore. Generally, the drilling fluid has a density in the range from about 9 to 20 pounds per gallon, more preferably from about 10 to 18 pounds per gallon and most preferably from about 12 to about 15.5 pounds per gallon.

Threaded casing sub 52 and the other components of closed baffle assembly 54 connected thereto are threadedly connected between a casing joint 48 and a casing joint 50. A threaded collar 68 having internal threads 70 at the upper and lower ends 71 and 72 respectively thereof may be utilized to connect casing joints 48 to threaded casing sub 52. Threaded casing sub 52 has an annular retaining recess 74 formed in an interior surface thereof.

Baffle assembly 54 includes a cylindrical collet 76 having a plurality of flexible collet fingers 78 including head portions 80 disposed within threaded casing sub 52. The head portions 80 of collet 76 include exterior sloping shoulders 82 thereon, which engage a sloping complementary annular shoulder 84 formed in the annular retaining recess 74 in the threaded casing sub 52.

A collet releasing sleeve 86 is slidably disposed within cylindrical collet 76 which is positioned to engage a cementing plug displaced into landing contact therewith. The collet releasing sleeve 86 includes an external annular surface 88 which contacts the head portions 80 of the collet 76 and maintains them in engagement with the annular retaining recess 74 in the threaded casing sub 52. At least one shear pin 90 (two are shown) is engaged with the cylindrical collet 76 and extends into a recess 92 in collet releasing sleeve 86. Collet releasing sleeve 86 is of a size and shape similar to the internal hollow core of a cementing plug and includes a central opening 94 extending therethrough. The opposite ends 96 and 98 of the collet releasing sleeve 86 each may include an annular serrated surface 100 and 102 respectively for preventing the rotation of the releasing sleeve in the event that it and similarly formed cementing plugs are drilled out of the casing string.

Collet 76 includes an annular recess 104 disposed in an external surface thereof. An annular lip seal 106 for providing a seal between the collet 76 and an internal surface of threaded casing sub 52 is disposed in the annular recess 104. In addition, an O-ring 108 is positioned within the annular recess 104 between a surface of the annular recess 104 and the annular lip seal 106. Alternatively, O-ring 108 may be positioned within a groove within annular recess 104 thereby pre-loading the annular lip seal 106 between a surface of the annular recess 104 and the annular lip seal 106. When fluid pressure is applied to the O-ring 108 and annular lip seal 106, O-ring 108 is forced towards an enlarged end portion 107 of annular lip seal 106 which in turn forces the annular lip seal 106 into contact with the interior surface of the threaded casing sub 52 whereby a seal is provided between threaded casing sub 52 and collet 76. Annular lip seal 106 is formed of a hard elastomer material, which will withstand high fluid pressures without extruding out of annular recess 104. However, because of the hardness of annular lip seal 106, a relatively high fluid pressure is required to force it into sealing contact with the threaded casing sub 52 when O-ring 108 is not present. The O-ring 108 is forced towards enlarged end portion 107 of the annular lip seal 106 at relatively low pressures thereby moving the lip seal into sealing contact with the interior surface of threaded casing sub 52 whereby it provides a seal at such low pressures.

A hollow baffle member 110, which includes a hollow core 111 similar in size and shape to the collet releasing sleeve 86 and a plurality of wipers 112 for contacting the inside surfaces of second casing 36 is rigidly attached to collet 76. Sealingly disposed within an opening 114 extending through the baffle member 110 is a predetermined fluid pressure operable valve 116. The valve 116 is preferably a rupturable valve member, which ruptures when the predetermined fluid pressure is exerted thereon. Valve 116 may therefore be referred to as rupturable valve member 116. Like collet releasing sleeve 86, baffle member 110 includes opposite annular serrated ends 118 and 120 for engaging the annular serrated surface 102 of the collet releasing sleeve 86 and a complementary serrated surface on a float collar or float shoe when landed thereon. At least one lock ring disposed in a groove, both designated by the numeral 122, is utilized to maintain the collet 76 and other parts of the assembly attached thereto within the threaded casing sub 52.

The operation of the closed baffle assembly 54 is described in detail in U.S. Pat. No. 5,829,526, the details of which are incorporated herein by reference. Drilling fluid is pumped into second casing 36 from the surface to increase the fluid pressure exerted on closed baffle assembly 54 to cause it to open. That is, the increasing fluid pressure is exerted on rupturable valve member 116 by way of the hollow interiors of collet releasing sleeve 86 and baffle member 110 until the predetermined pressure level required to rupture the rupturable valve member 116 is reached and the rupturable valve member 116 ruptures. After the opening of rupturable valve member 116 the air in the second casing 36 is allowed to percolate out of the second casing string.

Figure 3:
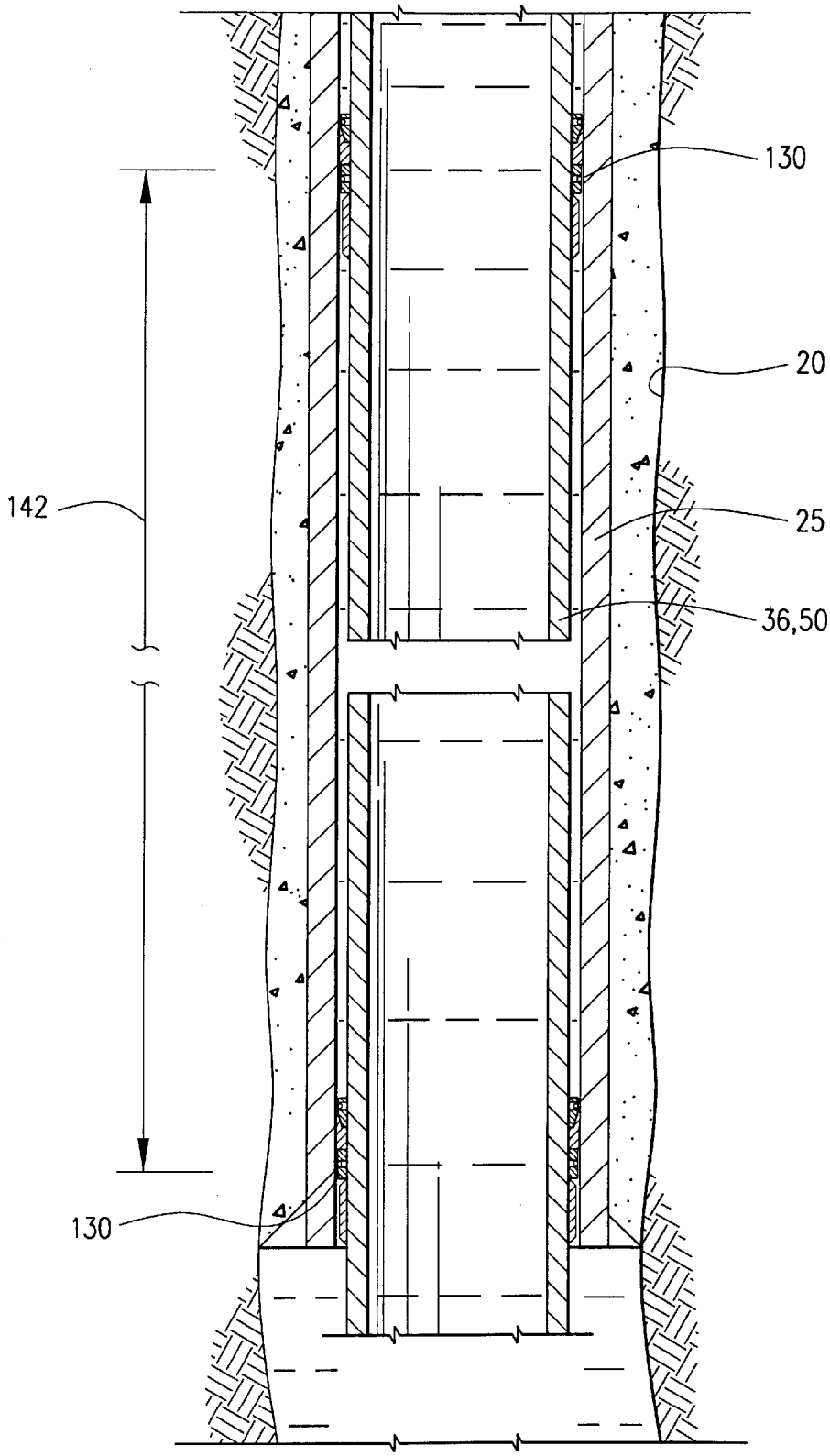
FIG. 3 shows a cross-sectional view of a portion of the second casing with fluid column supports of the present invention thereon.
Figure 4:
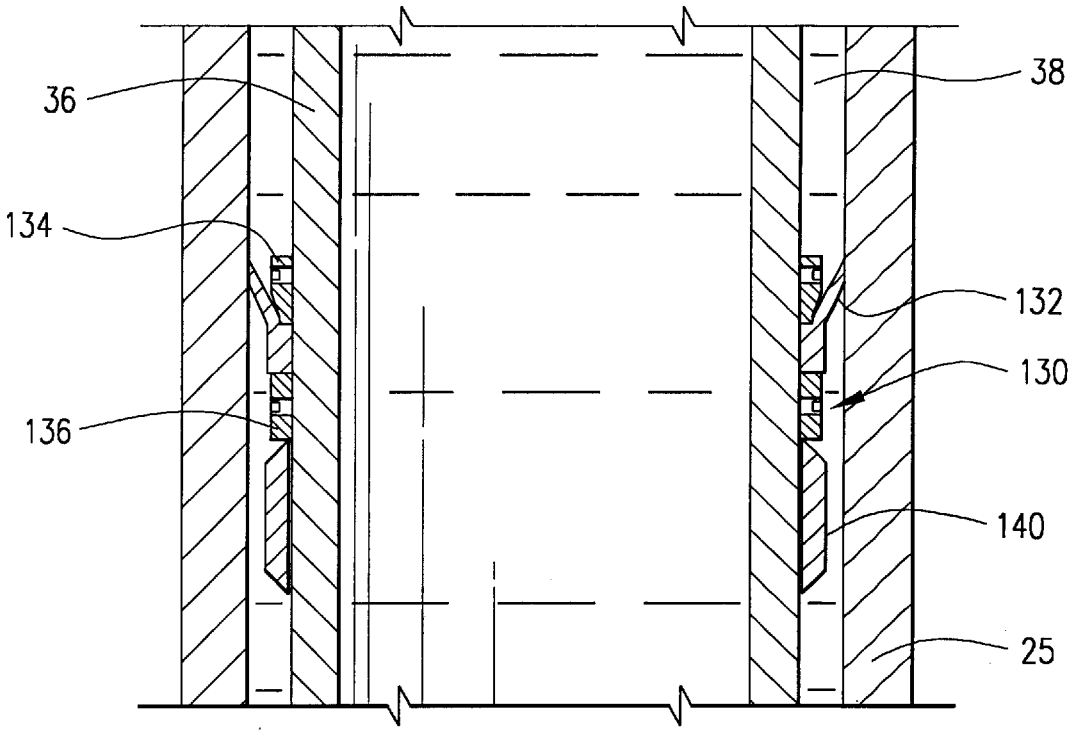
FIG. 4 is a close-up, cross-sectional view of the fluid column supports of the present invention.
Figure 7:
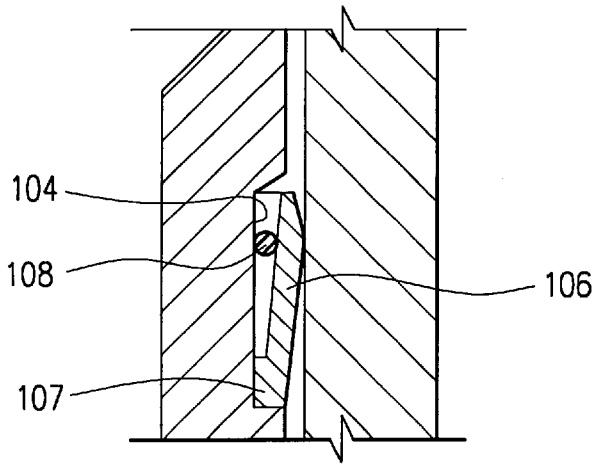
FIG. 7 shows an enlarged view of a portion of a baffle assembly.

Referring now to FIGS. 3 and 4, a fluid column support, designated by the numeral 130 is shown and described. Apparatus 10 includes fluid column support 130, which may be also referred to as a fluid column seal, disposed about second casing 36, and as shown preferably about casing joints 50 above baffle assembly 54. Fluid column support 130 includes an annular, preferably elastomeric seal 132 disposed about casing joints 50. Seal 132 is an upward-facing, cup-type seal disposed about casing joints 58 and engages inner surface 34 of casing 25. Seal 132 will thus allow flow upwardly in annulus 38 but prevents downward flow therethrough. Fluid column support 130 further comprises an upper retaining ring 134 and a lower retaining ring 136 to axially retain seal 132 about casing joints 58. Upper and lower retaining rings 134 and 136 may be mounted to casing joints 50 with set screws 138, or may be part of a casing collar connected in second casing 36. A centralizer 140 is disposed about and connected to casing joints proximate fluid column support 130. Centralizer 140, as is known in the art, will centralize casing joints 50 so that seal 132 will engage first casing 25 around the entire inner circumference thereof. As shown in the drawings, apparatus 10 includes at least one and preferably includes a plurality of fluid column supports 130. Fluid column supports 130 are preferably spaced at intervals 142 along casing joints 50 as depicted in FIG. 2 and 3. The spacing is such that at least one of the plurality of fluid column supports 130 will maintain engagement with first casing 25. Because at least one fluid column support 130 is always in engagement with casing 25, a fluid column will always be supported in annulus 38 between second casing 36 and casing 25. Therefore, in the event of a failure of either or both of first and second buoyancy chambers 46 or 49, such that drilling fluid in the wellbore will fill the chambers causing the fluid level in the well to drop, the fluid column will always be supported in annulus 38. Fluid column supports 130 thus provide a method for maintaining hydrostatic pressure in a well, and for maintaining a fluid column in an annulus when the fluid level in the well below the lowermost engaged fluid column support drops for any reason, such as a catastrophic failure of the first and/or second buoyancy chambers 46 and 49 respectively. As is well known in the art, a loss of fluid, and thus a loss of hydrostatic pressure can cause loss of well control which can be dangerous and costly.

Figure 5:
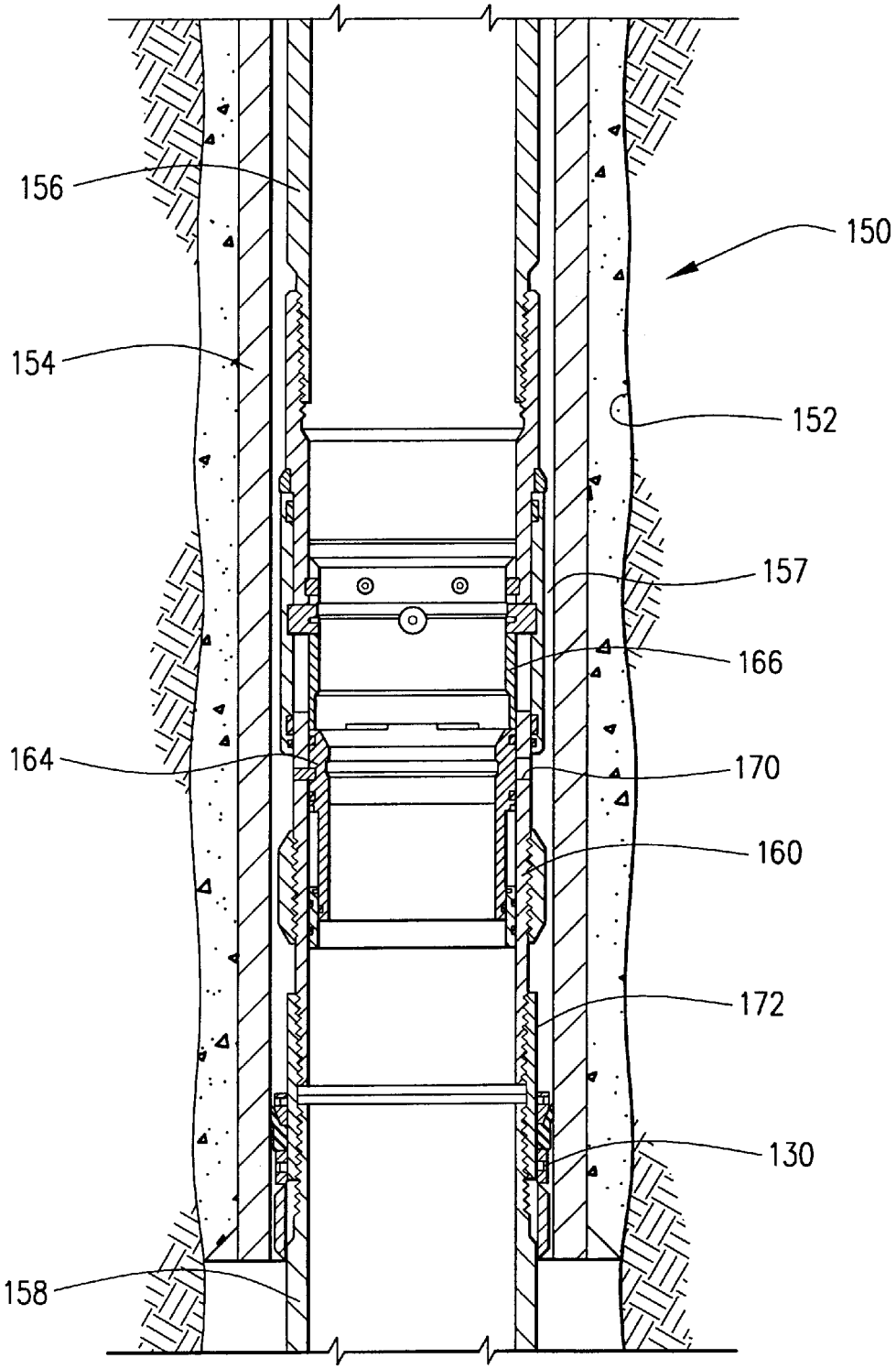
FIG. 5 is a cross-sectional view of the fluid column supports of the present invention used with a stage tool.
Figure 8:
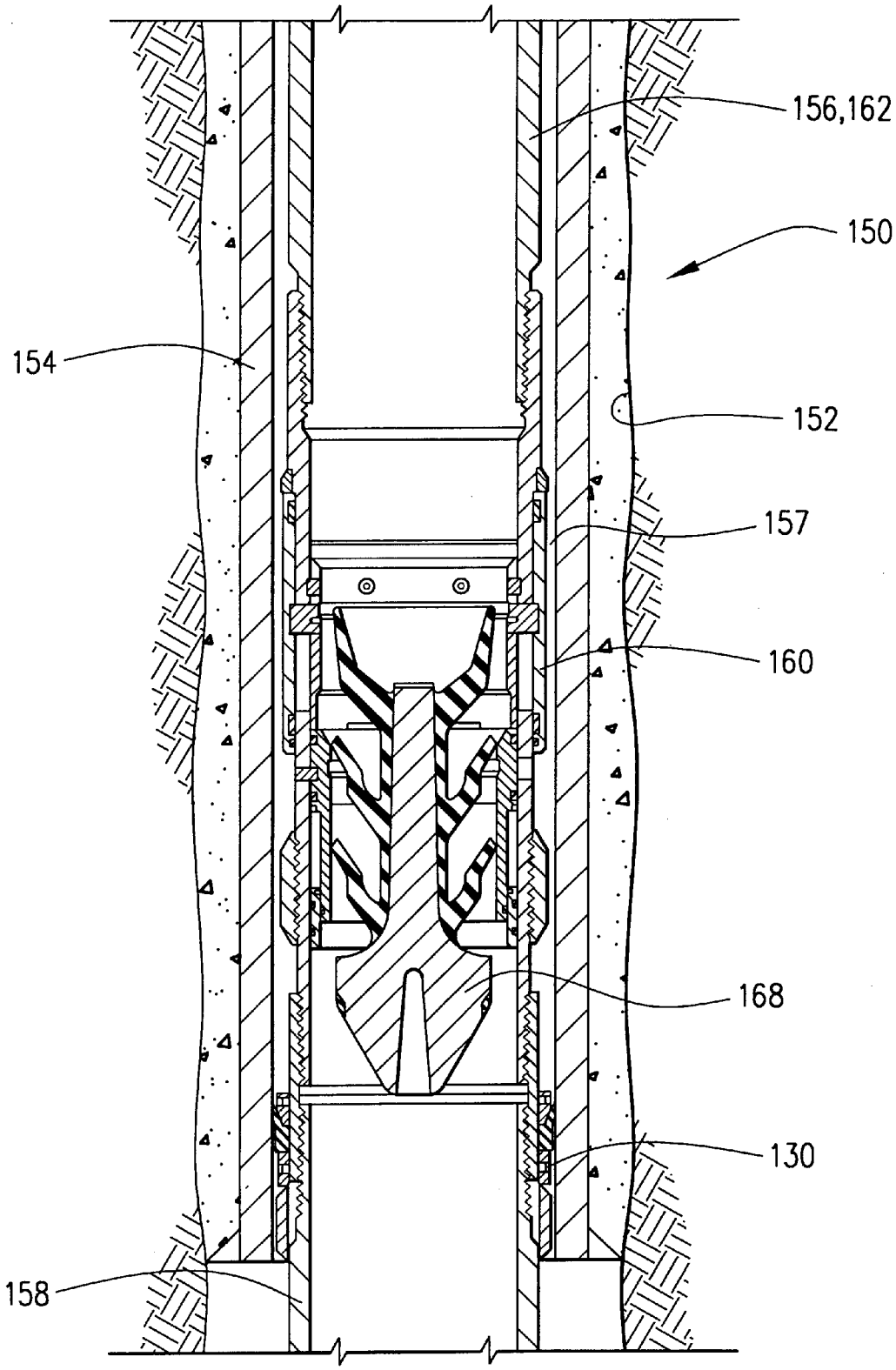
FIG. 8 is an enlarged cross-sectional view of a baffle assembly.
Figure 8:
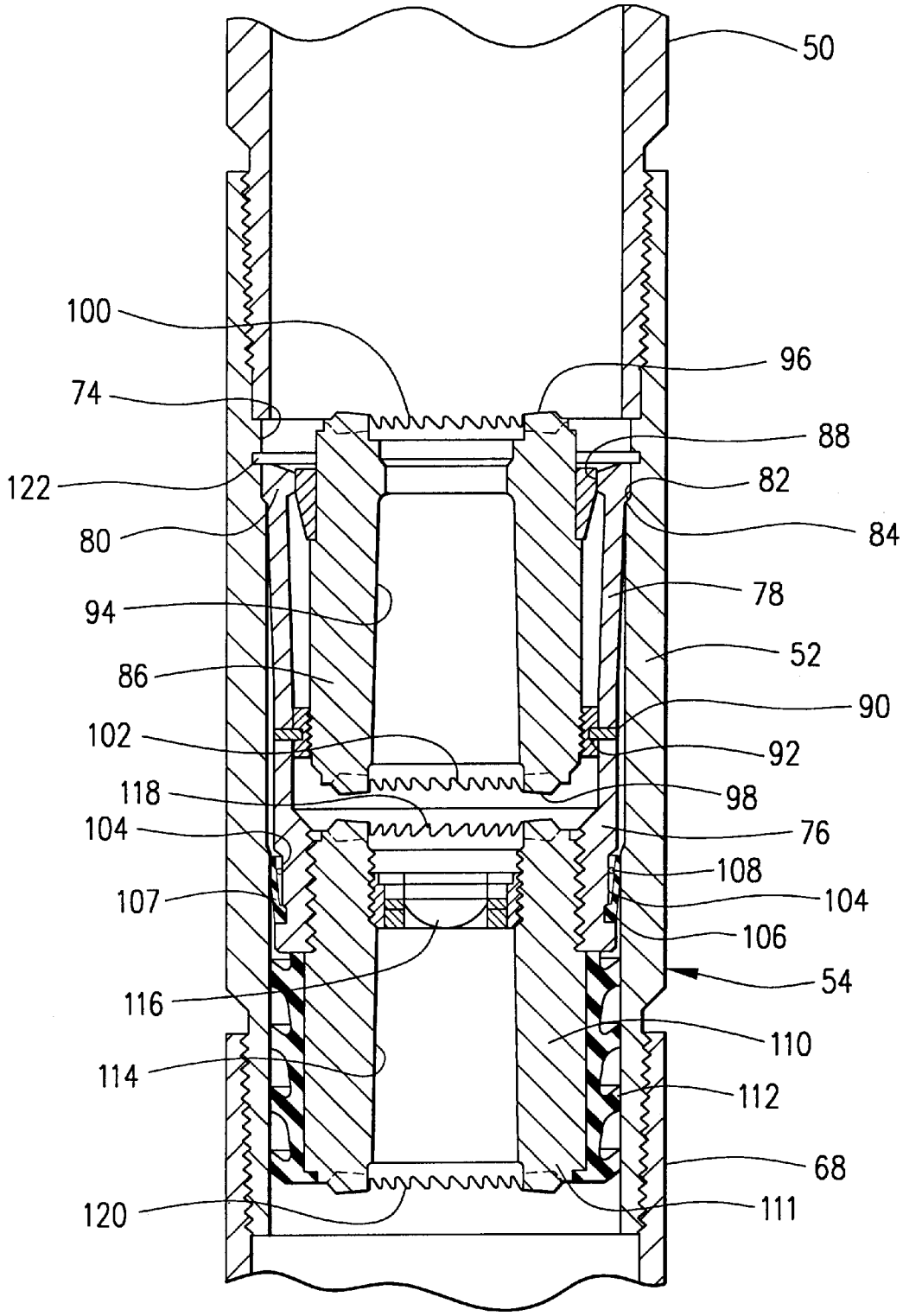

An additional embodiment of the apparatus of the present invention is shown in FIGS. 5 and 6. FIGS. 5 and 6 show a well 150 comprising a wellbore 152 having a first or outer casing 154 cemented therein. A second or inner casing 156 is shown disposed therein. First casing 154 and second casing 156 define an annulus 157 therebetween. Second casing 156 is comprised of a plurality of connected casing joints 158 connected to and extending downwardly from a lower end of a stage tool 160. A plurality of connected casing joints 162 is connected to and extends upwardly from stage tool 160 to the surface. Stage tool 160, as is well known in the art is used in connection with a stage cementing process and includes an opening sleeve 164 and a closing sleeve 166. As shown in FIG. 6, once first stage cementing has occurred, a displacement plug 168 is displaced through first casing 156. Displacement plug 168 will land on a seat (not shown) below stage tool 160. Once displacement plug 168 lands, an increase in pressure will cause opening sleeve 164 to move so that cement may be flowed through openings 170 to complete the cementing job well. The increase in pressure can either act differentially top to bottom on the inside of the stage tool 160 or differentially inside to outside of the stage tool 160.

As is known in the art, lost circulation can at times occur such that cement displaced through openings 170 will flow downwardly, due to the weight of the cement, as opposed to flowing out openings 170 and upwardly in annulus 157 between outer and inner casings 154 and 156, respectfully. Likewise, lost circulation can also cause a loss of hydrostatic pressure such that the opening sleeve cannot be opened.

The embodiment of FIG. 5 includes a fluid column support 130 disposed about second casing 156. Fluid column support 130, in the embodiment shown in FIG. 5, is disposed about internally threaded collar 172, which connects lower casing joints 158 to stage tool at 160. Fluid column support 130 is disposed about second casing 156 and is positioned so that in the event of lost circulation, or a fluid level drop in the well for any reason, fluid column support 130 will support a fluid column in annulus 157 such that cement displaced through openings 170 cannot flow downwardly past fluid column support 130. Fluid column support 130 will support the fluid column such that hydrostatic pressure above the tool will be sufficient to activate the stage tool for cementing. Thus, the present invention provides a method and apparatus for supporting or maintaining a fluid column in an annulus thus maintaining hydrostatic pressure in those instances where fluid level in the well drops for any reason, such as the failure of a buoyancy chamber or lost circulation in a stage cementing job.

While numerous changes to the apparatus and methods can be made by those skilled in the art, such changes are encompassed within the spirit of this invention as defined by the appended claims.

What is claimed is:

1. Apparatus for maintaining a fluid column in an annulus defined by a first casing cemented in a wellbore and a second casing being lowered through said first casing for placement in said wellbore, the wellbore having a fluid therein, the apparatus comprising:

a fluid column seal disposed about and movable with said second casing, wherein said fluid column seal is adapted to sealingly engage said first casing as said second casing is lowered therethrough, wherein a fluid in said well can flow upwardly past said fluid column seal, and wherein said fluid column seal prevents downward flow in said annulus so that a column of fluid is maintained in said annulus in the event of a drop in fluid level in said wellbore below said fluid column seal.

2. The apparatus of claim 1, further comprising a plurality of said fluid column seals disposed about said second casing, said fluid column seals being spaced apart at intervals along said second casing, at least one of said fluid column seals always being in sealing engagement with said first casing, thereby comprising an engaged column seal.

3. The apparatus of claim 2, further comprising a centralizer disposed about said casing proximate each said fluid column seal.

4. The apparatus of claim 2, wherein said second casing includes a buoyancy chamber, and wherein said buoyancy chamber is filled with a compressible fluid, said fluid column seals being adapted to maintain a column of fluid in said annulus in the event of a failure of said buoyancy chamber causing a fluid level drop in said wellbore below a lowermost engaged fluid column seal.

5. The apparatus of claim 4, wherein said buoyancy chamber is filled with air.

6. The apparatus of claim 4, further comprising a float shoe attached to a lower end of said second casing and a float collar connected in said second casing, said buoyancy chamber being defined between said float shoe and said float collar.

7. The apparatus of claim 2 wherein said fluid column seals comprise upward-facing, cup-type seals.

8. A method of placing a second casing in a deviated section of a deviated well, the well containing drilling fluid and having a first casing cemented therein, the method comprising:

trapping a lightweight compressible fluid in a buoyancy chamber defined by said second casing;

lowering said second casing into said well; and supporting a column of fluid in an annulus between said first casing and said second casing while said second casing is being lowered into said well, so that said column of fluid in said annulus will be maintained in the event a fluid level in said well below said column of fluid drops.

9. The method of claim 8, wherein said column of fluid is supported during said lowering step and after said second casing has reached a desired location in the wellbore.

10. The method of claim 8, wherein said supporting step comprises:

attaching a fluid column support to said second casing; and sealingly engaging said first casing with said fluid column support during said lowering step.

11. The method of claim 10, wherein said supporting step further comprises:

attaching a plurality of said fluid column supports to said second casing at spaced intervals; and maintaining engagement between said first casing and at least one of said fluid column supports as said second casing is lowered through said first casing.

12. The method of claim 11, wherein said fluid column supports will allow flow upwardly in said annulus, but will prevent flow downwardly therethrough when said fluid column supports engage said first casing.

13. Apparatus for facilitating the placement of a second casing string in a well containing drilling fluid, the well having a first casing string cemented therein, the apparatus comprising:

at least one fluid column support disposed in an annulus between said first and second casing strings for sup porting a column of said drilling fluid therein during placement of said second casing string, wherein said at least one fluid column support will support said column of drilling fluid if the level of said drilling fluid in said well below said fluid column support drops in said well.

14. The apparatus of claim 13 wherein said at least one fluid column support comprises an upward facing seal.

15. The apparatus of claim 13, wherein said at least one fluid column support allows flow upwardly in said annulus but prevents downward flow therethrough.

16. The apparatus of claim 13, wherein said at least one fluid column support is attached to said second casing string and is movable therewith.

17. The apparatus of claim 16, said at least one fluid column support comprising a plurality of said fluid column supports attached at intervals along said second casing string.

18. The apparatus of claim 17, wherein said second casing string defines a buoyancy chamber filled with a compressible fluid at a lower end thereof.

19. The apparatus of claim 18, wherein said compressible fluid comprises air.

20. The apparatus of claim 18, wherein at least one of said fluid column supports is always sealingly engaged with said first casing and will support a column of fluid in said annulus in the event said buoyancy chamber fails causing the fluid level in said well below said at least one engaged fluid column support to drop.

21. The apparatus of claim 17, wherein at least one of said plurality of fluid column supports will always be engaged with said first casing string, thereby supporting a column of fluid in said annulus.

* * * * *